US009783990B2

(12) United States Patent
Walker et al.

(10) Patent No.: US 9,783,990 B2
(45) Date of Patent: Oct. 10, 2017

(54) CONTINUOUS HANDRAIL SYSTEM

(71) Applicant: Peak Innovations Inc., Richmond (CA)

(72) Inventors: Simon Walker, Delta (CA); Charles Hilliard Young, Richmond (CA); Hou Jun (Frank) Fan, Surrey (CA); Craig Raymond Lawson, Burnaby (CA)

(73) Assignee: Peak Innovations Inc., Richmond (CA)

( * ) Notice: Subject to any disclaimer, the term of this patent is extended or adjusted under 35 U.S.C. 154(b) by 379 days.

(21) Appl. No.: 14/613,267

(22) Filed: Feb. 3, 2015

(65) Prior Publication Data

US 2015/0292212 A1 Oct. 15, 2015

(30) Foreign Application Priority Data

Apr. 10, 2014 (CA) ..... 2848571

(51) Int. Cl.
*E04F 11/18* (2006.01)

(52) U.S. Cl.
CPC ..... *E04F 11/1808* (2013.01); *E04F 11/1804* (2013.01); *E04F 11/1838* (2013.01)

(58) Field of Classification Search
CPC ..... E04F 11/1802; E04F 11/1804; E04F 11/1808; E04F 11/1836
See application file for complete search history.

(56) References Cited

U.S. PATENT DOCUMENTS

| | | | | |
|---|---|---|---|---|
| 3,071,350 | A * | 1/1963 | Opie | E04F 11/1812 248/222.13 |
| 3,982,735 | A * | 9/1976 | Fornells | B63B 17/04 256/13.1 |
| 4,002,322 | A * | 1/1977 | Matsubara | E04F 11/1804 256/65.06 |
| 4,078,773 | A * | 3/1978 | Ellingson, Jr. | E04F 11/1804 248/251 |
| 4,220,316 | A * | 9/1980 | Naka | E04F 11/1836 256/1 |
| 5,529,288 | A * | 6/1996 | Cheng-I | E04F 11/1804 256/59 |
| 8,356,802 | B2 * | 1/2013 | Reich | E04F 11/1836 256/65.09 |
| 2014/0097394 | A1 * | 4/2014 | Hsieh | E04F 11/1804 256/65.15 |

FOREIGN PATENT DOCUMENTS

| | | | |
|---|---|---|---|
| FR | 2 853 343 | * 10/2004 | E04F 11/18 |

* cited by examiner

*Primary Examiner* — Michael P Ferguson
(74) *Attorney, Agent, or Firm* — Smiths IP; Lawrence Chan

(57) ABSTRACT

A handrail assembly comprises an elongated railing and a plurality of brackets. The railing has two lateral channels extending along its length and a central member extending between the two lateral channels. At least one of the brackets has a base and two prongs extending away from the base. Each of the prongs engages one of the lateral channels. The engagement of the railing with the brackets forms a cavity that is defined, at least in part, by the central member, the base, and the prongs.

19 Claims, 6 Drawing Sheets

Fig. 4
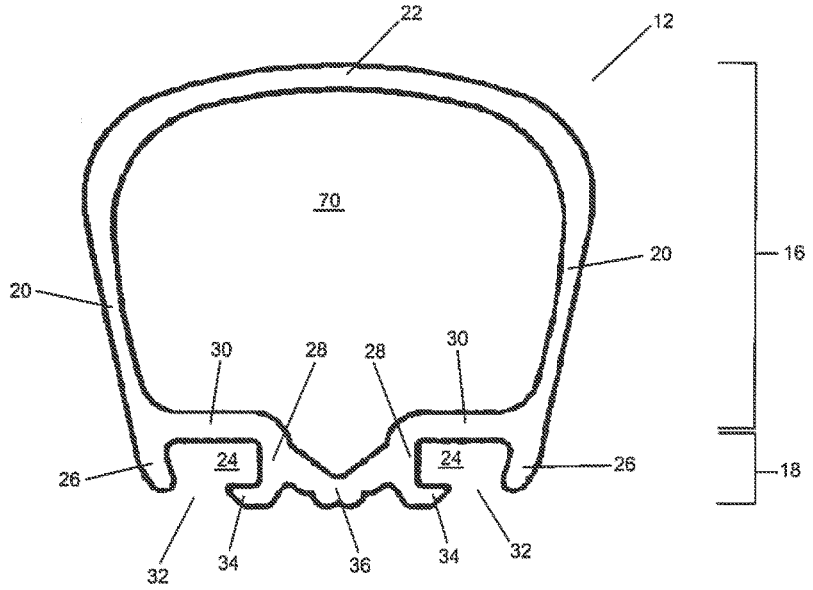
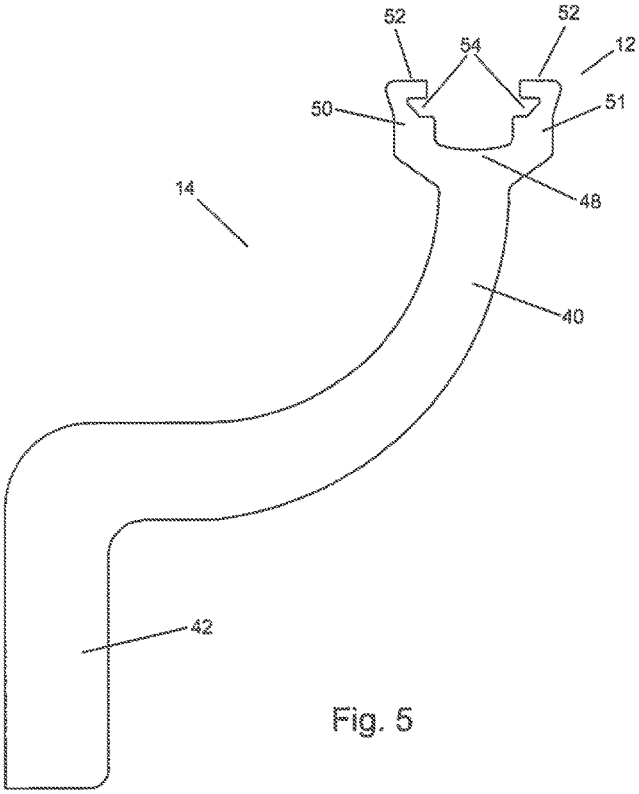
Fig. 5
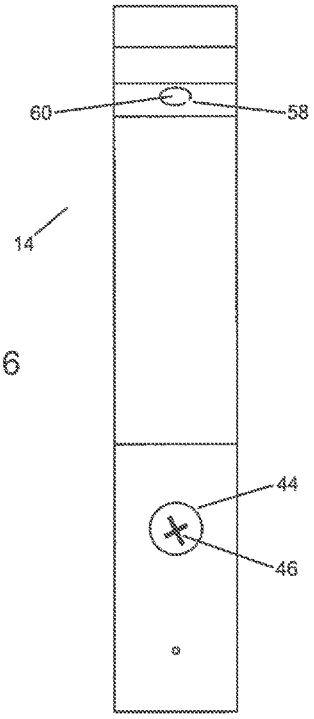
Fig. 6

Fig. 7
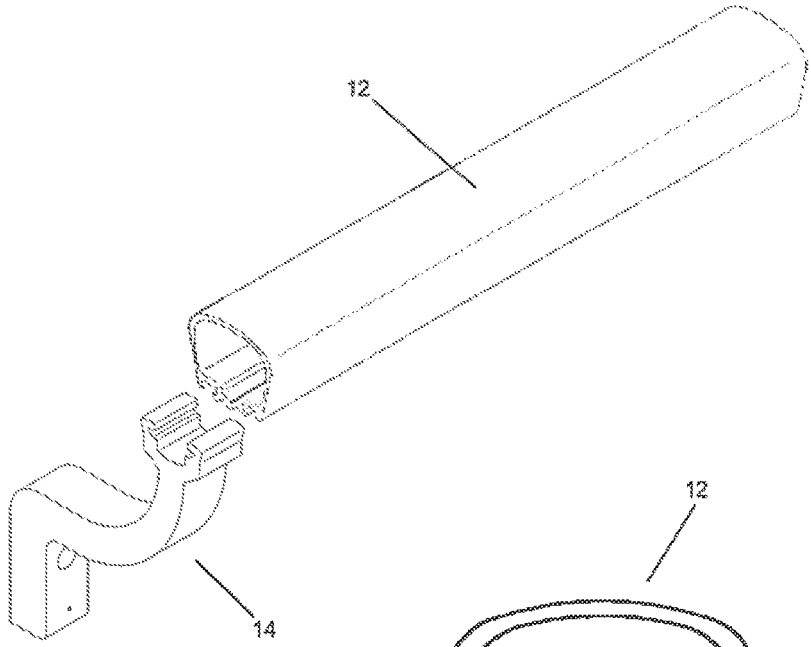
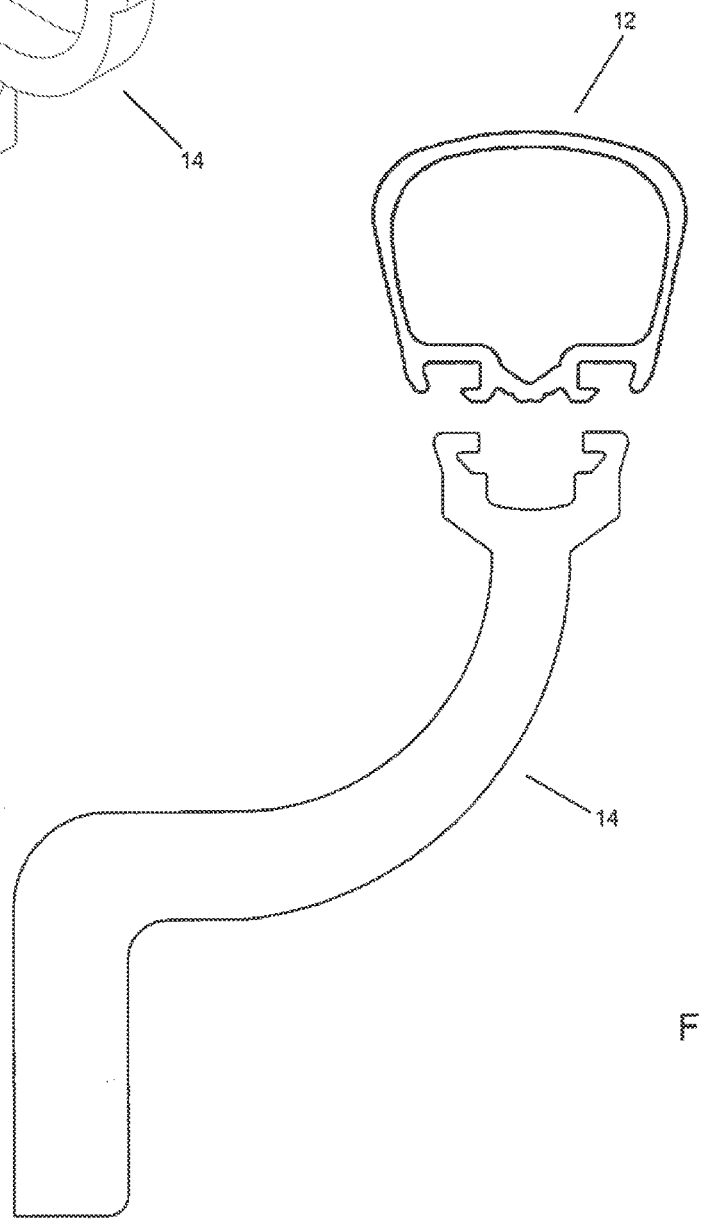
Fig. 8

Fig. 10
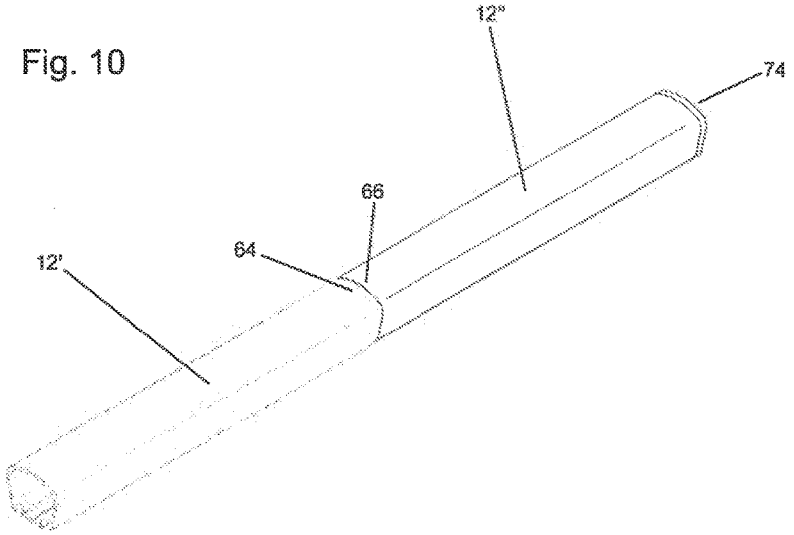
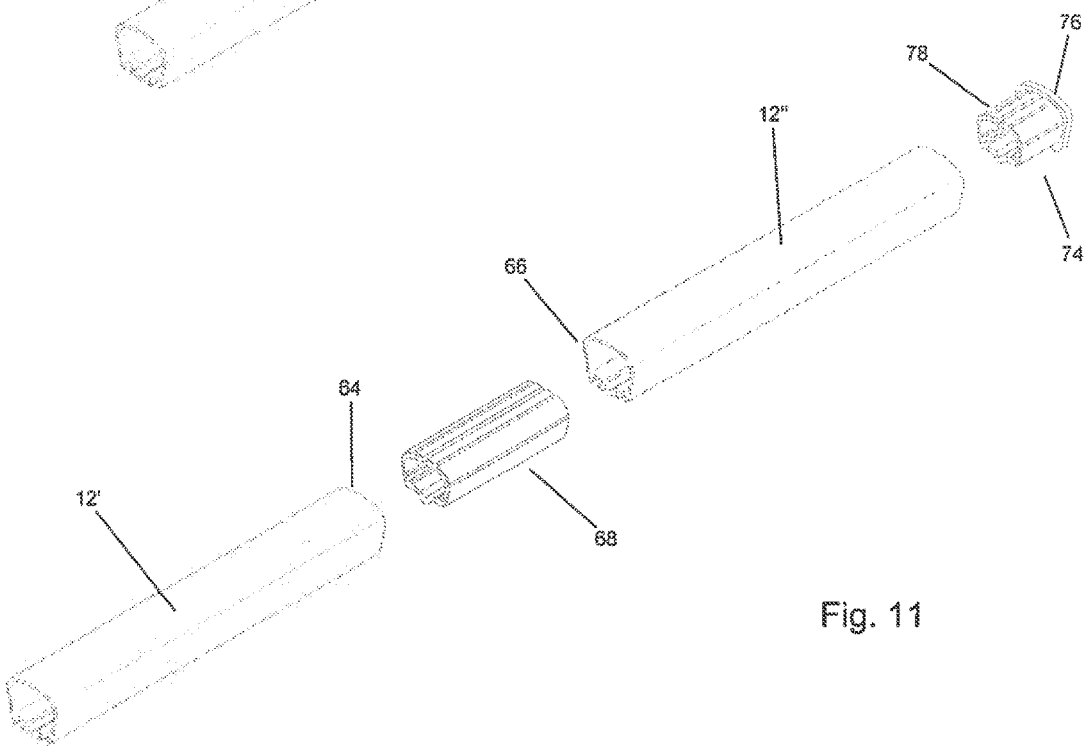
Fig. 11

Fig. 13
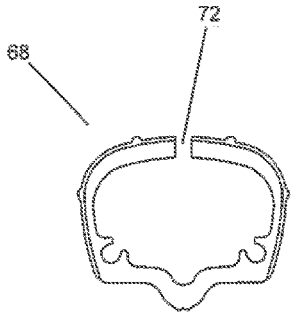
Fig. 12
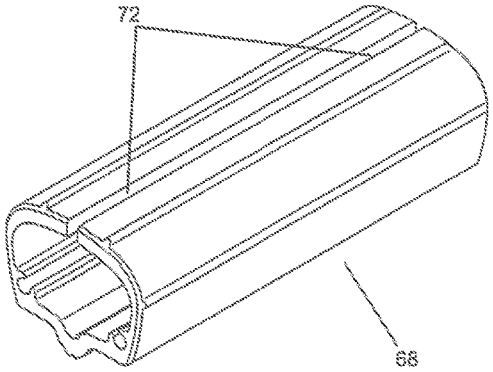
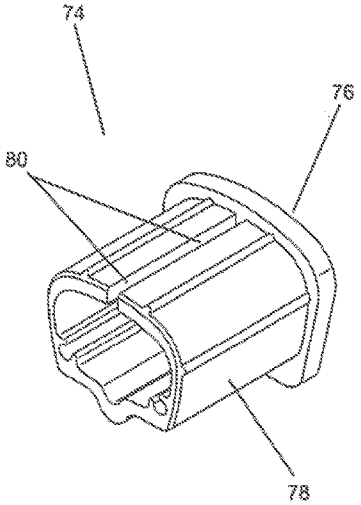
Fig. 14
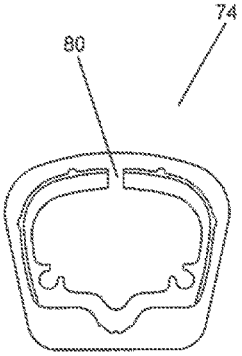
Fig. 15
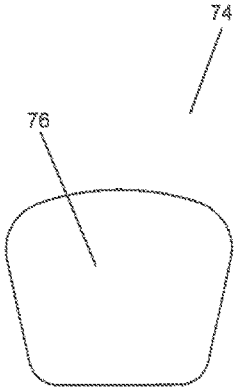
Fig. 16

CONTINUOUS HANDRAIL SYSTEM

FIELD OF THE INVENTION

The invention relates to the field of handrails, and in particular, to continuous handrails.

BACKGROUND OF THE INVENTION

Handrails are rails onto which a person may grasp, providing stability and support for the person. They are typically found in conjunction with stairways or ramps. Handrails may be attached to one or both of the walls adjacent to the stairway or ramp, or they may be supported by posts. In either case, handrails provide a longitudinal gripping surface running generally parallel to the incline of the stairway or ramp. Although handrails are commonly found next to stairways and ramps, they can also be found next to flat locations, especially where mobility and safety are concerns, such as in bathrooms and hospital corridors.

One type of handrail is the continuous handrail. A continuous handrail has a continuous, unbroken surface. Building codes in some jurisdictions require that continuous handrails extend for at least the entire length of the stairway. As such, a person ascending up or descending down the stairway is able to grasp onto a portion of the continuous handrail for at least the entire flight of stairs.

U.S. Pat. No. 8,356,802 to Reich discloses a handrail assembly comprising a handrail and a bracket. The handrail has an inverted T-shaped channel on the bottom of the handrail, where the bottom portion of the T-shaped channel is narrower than the upper portion. The head of the bracket is rounded and has a width that is greater is its length. When the head of the bracket is inserted into the T-shaped channel and rotated 90°, the geometry of the T-shaped channel and the bracket are such so that the head of the bracket is held in place within the T-shaped channel. However, slight imperfections in the sizing of the T-shaped channel and/or the head of the bracket will result in the handrail being apt to wobble or move. Furthermore, the handrail is supported only by a single point of contact (namely the head of the bracket), which may fail if too large a force is exerted on the handrail.

Accordingly, a need exists for an improved handrail that overcomes the deficiencies noted above.

SUMMARY OF THE INVENTION

According to the invention, a handrail assembly comprises an elongated railing and a plurality of brackets. The railing has two lateral channels extending along a length of the railing and a central member extending between the two lateral channels. At least one bracket has a base and two prongs. The prongs extend away from the base, and each of the prongs engages one of the lateral channels. The engagement of the railing with the bracket forms a cavity that is defined at least in part by the central member, the base, and the prongs.

In another aspect of the invention, the railing further comprises one or more channel protrusions, with the channel protrusions extending over a portion of the lateral channels.

In a further aspect of the invention, one or both of the prongs comprises a notch, with the notch being adapted to slidably engage one of the channel protrusions.

In yet another aspect of the invention, the at least one bracket further comprises an arm extending from the base and a mount for securing the handrail assembly to a structure. The mount is spaced apart from the railing.

In another aspect of the invention, the railing is formed from a single piece of material In yet another aspect of the invention, the railing is formed by extrusion.

In a further aspect of the invention, one or both of the prongs further comprises a fastener surface, with the fastener surface comprising one or more fastener openings extending through the prong. The fastener openings are adapted to receive fasteners for fixing said railing to the at least one bracket.

In yet another aspect of the invention, the fastener openings are angled such that the fastener openings allow the fasteners to extend through the prong and through the cavity to engage the central member.

In a further aspect of the invention, the fastener surface is substantially perpendicular to the fastener openings.

In another aspect of the invention, a handrail assembly comprises two or more elongated railings arranged end-to-end and a plurality of brackets. Each of the railings comprises two lateral channels extending along a length of the railing and a central member extending between the two lateral channels. Each of the brackets comprises a base and two prongs. The two prongs extend away from the base, and each of the prongs engages one of the lateral channels. The engagement of one of the railings with one of the brackets forms a cavity. The cavity is defined at least in part by the central member, the base, and the prongs.

In a further aspect of the invention, each of the lateral channels are defined at least in part by an outer channel wall, an inner channel wall, and an upper channel wall.

In yet another aspect of the invention, the central member extends between the inner channel walls of the lateral channels.

In another aspect of the invention, each of the railings further comprises a top surface and two side walls. The side walls extend generally downwardly from the top surface, and each of the side walls is attached to one of the outer channel walls.

In still another aspect of the invention, each of the railings comprises an inner hollow. The inner hollow is defined at least in part by the top surface, the side walls, the upper channel walls, and the central member.

In another aspect of the invention, the handrail assembly further comprises one or more joins that are adapted to connect one of the railings to an adjacent one of the railings.

In a further aspect of the invention, each of the joins extends across the longitudinal end of one railing and the longitudinal end of an adjacent railing.

In yet a further aspect of the invention, each of the joins insertably engages with the inner hollows of one railing and an adjacent railing.

In still another aspect of the invention, each of the joins is substantially hollow and comprises an outer cross-section perimeter and a longitudinal slit. The outer cross-sectional perimeter is greater than a perimeter of the inner hollow.

In a further aspect of the invention, the handrail assembly further comprises one or more caps. Each of the caps comprises an end surface and a railing attachment portion. The railing attachment portion insertably engages with the inner hollow at one longitudinal end of one of the railings.

In a yet further aspect of the invention, the railing attachment portion is substantially hollow and comprises an outer cross-sectional perimeter and a longitudinal slit. The outer cross-sectional perimeter is greater than a perimeter of the inner hollow.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The preferred embodiment of the invention will be described by reference to the drawings thereof, in which:

FIG. 4 is a front elevational view of a railing of the handrail assembly;

FIG. 5 is a front elevational view of a bracket of the handrail assembly;

FIG. 6 is a side view of the bracket of FIG. 5;

FIG. 7 is a perspective view of a railing and a bracket before they are attached together;

FIG. 8 is a front exploded view of a railing and a bracket;

FIG. 10 is a perspective view of two railings joined together;

FIG. 11 is an exploded view of FIG. 10;

FIG. 12 is a perspective view of a join;

FIG. 13 is a front elevational view of the join of FIG. 12;

FIG. 14 is a perspective view of a cap;

FIG. 15 is a front elevational view of the cap of FIG. 14; and

FIG. 16 is a rear elevational view of the cap of FIG. 14.

DESCRIPTION OF THE PREFERRED EMBODIMENT

Figure 1:
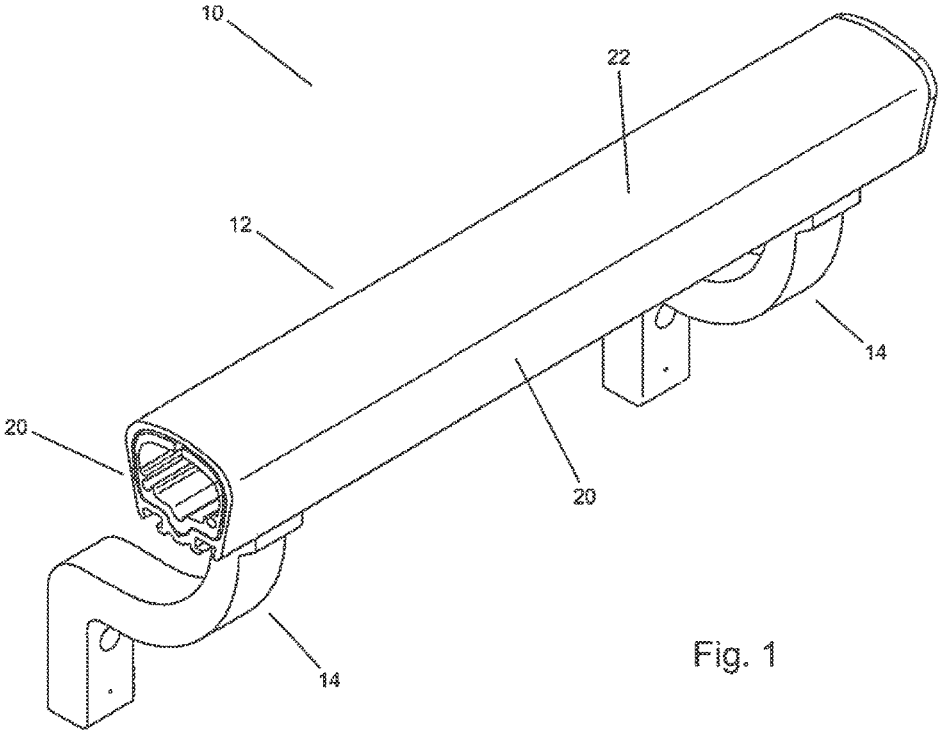
FIG. 1 is a perspective view of a handrail assembly in accordance with the present invention.
Figure 2:
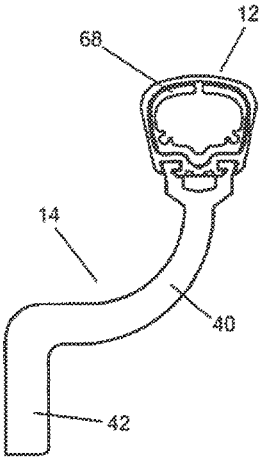
FIG. 2 is a front elevational view of the handrail assembly of FIG. 1.
Figure 3:
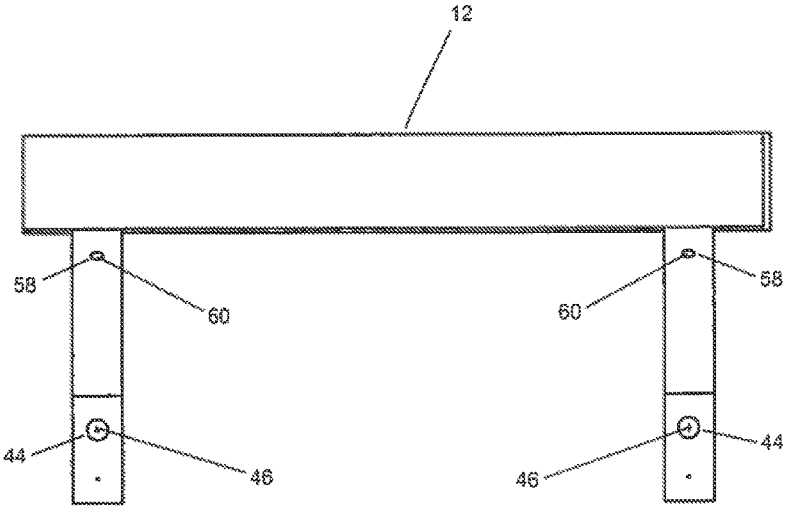
FIG. 3 is a side view of the handrail assembly of FIG. 1.

Referring to FIGS. 1 to 6, a handrail assembly 10 is generally shown comprising one or more elongated railings 12 and one or more brackets 14. The railings 12 each comprise a handle portion 16 and an attachment portion 18. The handle portion 16 is intended to be grasped by a person and may be contoured and configured in different shapes. The handle portion 16 of the railing 12 shown in FIG. 1 has generally tapered side walls 20 and a curved top surface 22, but different shapes are also possible. The side walls 20 and the top surface 22 preferably extend for the length of the railing 12. The attachment portion 18 is used to attach the railing 12 to the brackets 14, as described in greater detail below. The brackets 14 support the railing 12 from below and secure the handrail assembly 10 to a structure (not shown), such as a wall or a post.

Referring to FIG. 4, the attachment portion 18 comprises two lateral channels 24, with each lateral channel 24 defined at least in part by an outer channel wall 26, an inner channel wall 28, and an upper channel wall 30. At least a portion of each of the channels 24 is open from below, forming channel openings 32. Preferably, a portion of the side walls 20 and a portion of the outer channel walls 26 are attached together and are continuous with one another. In addition, a channel protrusion 34 may extend from one or both of the inner channel walls 28. These channel protrusions 34 extend over a portion of the lateral channels 24. A central member 36 spans the two inner channel walls 28. Preferably, the lateral channels 24 (and thereby the outer channel walls 26, the inner channel walls 28, the upper channel walls 30, the channel protrusions 34) and the central member 34 extend for the length of the railing 12, such that a cross-section of the railing 12 is substantially similar throughout the length of the railing 12.

As mentioned above, the central member 34 spans the two inner channel walls 28. The shape of the central member 34 may vary. In the embodiment shown in FIG. 4, the central member 34 is substantially U-shaped or V-shaped, when the railing 12 is viewed in cross-section. Other shapes are also possible. As shown in FIG. 4, the top surface 22, the side walls 20, the upper channel walls 30, and the central member 36 of the railing 12 define an inner hollow 70. Preferably, the railing 12 is formed from a single sheet of material, such as metal or another suitable material. Alternatively, the railing 12 may be formed by extrusion.

Referring to FIGS. 5 to 6, the brackets 14 may comprise a head 38, an arm 40, and a mount 42. The mount 42 comprises one or more mount fastener openings 44 adapted to receive mount fasteners 46, such as screws. The mount fasteners 46 serve to secure the bracket 14 to an appropriate wall or post (not shown). The head 38 is attached to the railing 12.

The arm 40 extends between the mount 42 and the head 38. The arm 40 acts to space the head 38 (and thereby the railing 12) away from the wall or post to which the mount 42 is attached. In doing so, the railing 12 is able to be easily grasped by the person's hand without interference from the wall or post. In the embodiment shown in FIGS. 5 to 6, one end of the arm 40 extends generally downwardly from the head 38 for a distance before curving. The other end of the arm 40 is attached to the mount 42. Preferably, the head 38, the arm 40, and the mount 42 are constructed from a unitary piece of material.

Referring to the head 38 in more detail, the head 38 comprises an inner prong 50, an outer prong 51, and a base 48. Each of the prongs 50, 51 has an end 52. Proximal to the end 52, a notch 54 may be formed on the inner surface of the prongs 50, 51.

Figure 9:
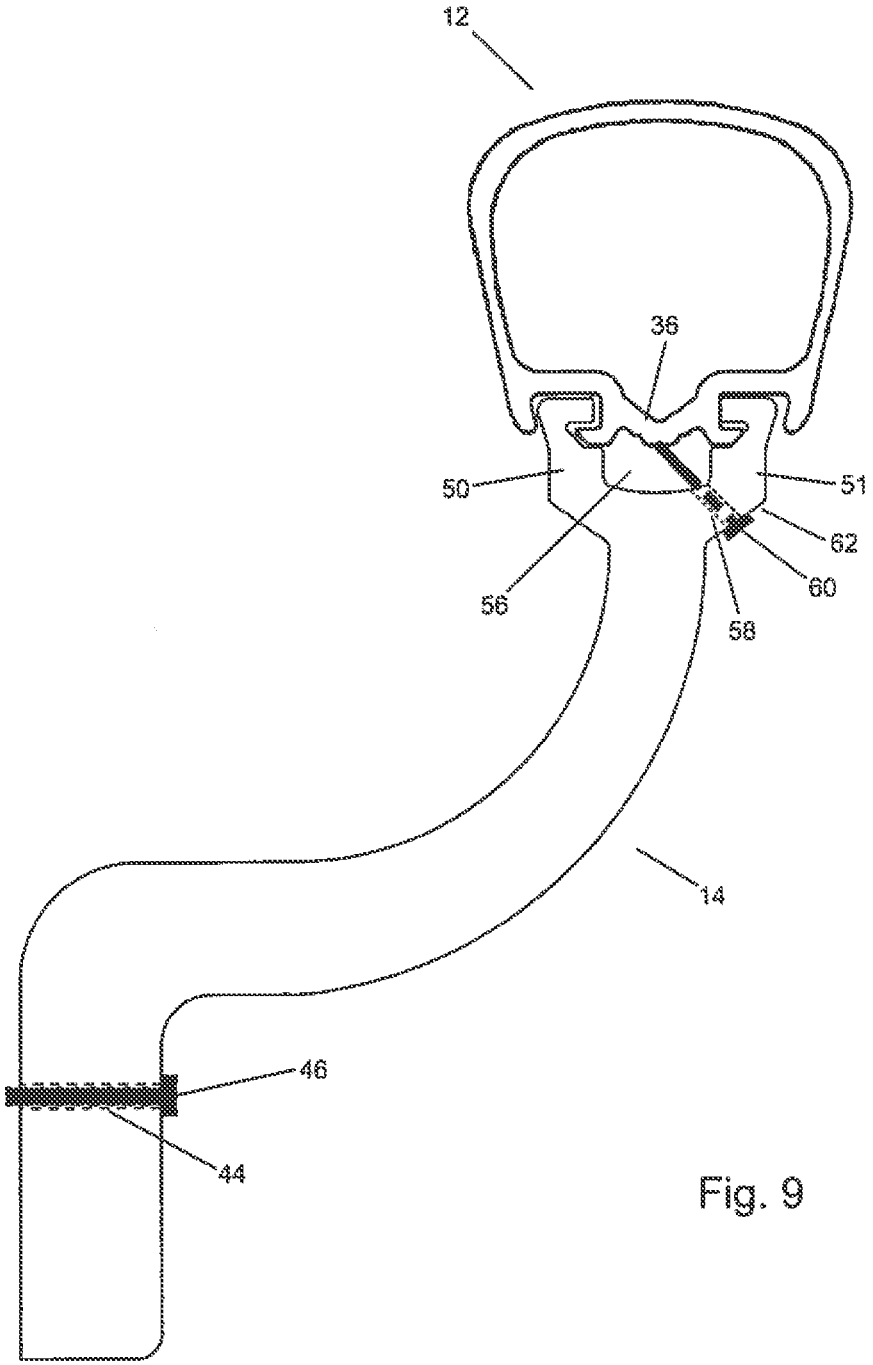
FIG. 9 is a front elevational view of a railing and a bracket attached together.

Referring to FIGS. 7 to 9, the railing 12 and the bracket 14 may be attached in the following manner. The ends 52 of the prongs 50, 51 can slide into the lateral channels 24 of the attachment portion 18. In order to do so, the bracket 14 is placed at one end of the railing 12, with the notches 54 being proximate to the channel protrusions 34 (as shown in FIG. 7). The bracket 14 is then slid longitudinally along the length of the railing 12. The bracket 14 is able to slide securely longitudinally along the railing 12 without the two separating because the notches 54 grip the channel protrusions 34. Preferably, the ends 52 of the prongs 50, 51 are in snug fit with the outer channel walls 26, the inner channel walls 28, and the upper channel walls 30 (as shown in FIG. 9). Also, as the lateral channels 24 preferably extend for the length of the railing 12, the bracket 14 can be slid along the railing 12 to any position along the length of the railing 12. Typically, the railing 12 will be supported by a number of brackets 14. The brackets 14 can be attached one by one to the railing 12.

Alternatively, where the bracket 14 has already been fixed in place (e.g. by mounting to the wall or post), the railing 12 may be attached to the bracket 14 by placing one end of the railing 12 next to the bracket 14, again with the notches 54 being proximate to the channel protrusions 34. The railing 12 can then be slid through the bracket 14, again with the ends 52 of the prongs 50, 51 sliding into and then through the lateral channels 24 of the attachment portion 18.

As best seen in FIG. 9, at the location where the bracket 14 is engaged with the railing 12, a cavity 56 is formed. The cavity 56 is defined, at least in part, by the inner prong 50, the outer prong 51, the base 48, and the central member 36.

Although the embodiment shown in FIGS. 1 to 9 depicts the channel protrusions 34 extending from the inner channel walls 28 over a portion of the lateral channels 24, it is also possible for the channel protrusions 34 to instead extend from the outer channel walls 26 over a portion of the lateral channels 24. In this embodiment, the notches 54 on the prongs 50, 51 would be located on the outer surfaces of the prongs 50, 51 (rather than the inner surfaces).

As described above, one or more of the brackets 14 can be attached to the railing 12 by slidably engaging the prongs 50, 51 into the lateral channels 24. However, in order to securely fix the bracket 14 at a particular location along the railing 12, one or more railing fastener openings 58 are provided one or both of the prongs 50, 51. Fastener surfaces 62 are located along the lower portions of the prongs 50, 51. The railing fastener openings 58 are located on the fastener surfaces 62 and extend through the prongs 50, 51. In the embodiment shown in FIGS. 1 to 9, one railing fastener opening 58 is provided on the fastener surface 62 of the outer prong 51, although it is to be understood that other numbers of railing fastener openings 58 are also possible.

The railing fastener openings 58 are adapted to receive railing fasteners 60, such as screws, that extend through the railing fastener openings 58. Preferably, the rail fastener openings 58 are angled such that the railing fasteners 60, when inserted, can extend through the outer prong 51, into the cavity 56, and engage the central member 36 (as shown in FIG. 9). This engagement secures the railing 12 to the bracket 14 and prevents any further sliding motion between the railing 12 and the bracket 14. The interior of the railing fastener openings 58 may be threaded to assist in receiving the railing fasteners 60. Preferably, the fastener surfaces 62 are angled such that they are substantially perpendicular to the railing fastener openings 58 and are angled between approximately 30° and 60° to the horizontal.

If a single railing 12 is not of sufficient length for a particular purpose, additional railings 12 may be added as needed. For example, referring to FIGS. 10 and 11, a first end 64 of a first railing 12' may be joined to a second end 66 of a second railing 12" using one or more joins 68. Referring to FIGS. 12 and 13, the cross-section of the join 68 may generally follow the shape of the inner hollow 70 of the railings 12', 12". One end of the join 68 is snugly inserted into the first end 64 of the first railing 12', while the other end of the join 68 is snugly inserted into the second end 66 of the second railing 12". Preferably, the outer perimeter of the join 68 may be slightly greater than the perimeter of the inner hollow 70. In order for the join 68 to snugly fit within the railings 12', 12", a join slit 72 is provided that extends along the longitudinal length of the join 68. The join slit 72 allows for the join 68 to be slightly compressed, thereby reducing its outer perimeter. This slight reduction in the outer perimeter allows for the join 68 to be inserted into the railings 12', 12". Once inserted into the railings 12', 12", the join 68 can then try to revert to its previous shape, at which time it will push outwards against the walls of the inner hollow 70. This friction assists in securing the railings 12', 12" together.

The ends of the railings 12 may be covered with a cap 74. Referring to FIGS. 10, 11, and 14 to 16, the cap 74 comprises an end surface 76 and a railing attachment portion 78. The end surface 76 is preferably smooth. The railing attachment portion 78 has a cross-section that may generally follow the shape of the inner hollow 70 of the railings 12. The railing attachment portion 78 is snugly inserted into one end of the railing 12. Preferably, the outer perimeter of the railing attachment portion 78 may be slightly greater than the perimeter of the inner hollow 70. In order for the railing attachment portion 78 to snugly fit within the railings 12, a cap slit 80 is provided that extends along a length of the railing attachment portion 78. The cap slit 80 allows for the railing attachment portion 78 to be slightly compressed, thereby reducing its outer perimeter. This slight reduction in the outer perimeter allows for the railing attachment portion 78 to be inserted into the railings 12. Once inserted into the railing 12, the railing attachment portion 78 can then try to revert to its previous shape, at which time it will push outwards against the walls of the inner hollow 70. This friction assists in securing the cap 74 to the railing 12.

The presence of the two prongs 50, 51 provides two attachment points for the bracket 14 to the railing 12. This provides additional stability and strength to the railing 12 and reduces wobbling of the railing 12.

It will be appreciated by those skilled in the art that the preferred embodiment has been described in some detail but that certain modifications may be practiced without departing from the principles of the invention.

The invention claimed is:

1. A handrail assembly comprising:

an elongated railing, said railing comprising:

two lateral channels defined within a lower surface of railing and extending along a length of said railing, each of said lateral channels comprising an upper channel wall;

a central member longitudinally extending between said two lateral channels; and a pair of opposing channel protrusions, each of said channel protrusions extending from and longitudinally along a respective outer sidewall surface of said central member, wherein said channel protrusions extend over a portion of said lateral channels;

wherein a recess is defined within a lower surface of said central member between said lateral channels;

a plurality of brackets, at least one bracket comprising:

a base; and two prongs extending away from said base, wherein each of said prongs engages one of said lateral channels and a respective one of said upper channel walls, and wherein one or both of said prongs comprises a fastener surface comprising one or more fastener openings extending through said prong and adapted to receive fasteners for fixing said railing to said at least one bracket;

wherein each of said prongs comprises a notch, said notch being adapted to slidably engage a respective one of said channel protrusions;

wherein engagement of said railing with said at least one of said brackets forms a cavity defined at least in part by said central member, said base, and said prongs; and wherein said fastener openings are angled such that said fastener openings allow said fasteners to extend through said prong and through said cavity to engage said recess in said central member at a location spaced away from said lateral channels.

2. The handrail assembly of claim 1, wherein said at least one bracket further comprises:

an arm extending from said base; and a mount for securing said handrail assembly to a structure, wherein said mount is spaced apart from said railing.

3. The handrail assembly of claim 1, wherein said railing is formed from a single piece of material.

4. The handrail assembly of claim 1, wherein said railing is formed by extrusion.

5. The handrail assembly of claim 1, wherein said fastener surface is substantially perpendicular to said fastener openings.

6. A handrail assembly comprising:

two or more elongated railings arranged end-to-end, each of said railings comprising:

two lateral channels defined within a lower surface of railing and extending along a length of said railing, each of said lateral channels comprising an upper channel wall;

a central member longitudinally extending between said two lateral channels; and a pair of opposing channel protrusions, each of said channel protrusions extending from and longitudinally along a respective outer sidewall surface of said central member, wherein said channel protrusions extend over a portion of said lateral channels;

wherein a recess is defined within a lower surface of said central member between said lateral channels;

a plurality of brackets, each of said brackets comprising:

a base; and two prongs extending away from said base, wherein each of said prongs engages one of said lateral channels and a respective one of said upper channel walls, and wherein one or both of said prongs comprises a fastener surface comprising one or more fastener openings extending through said prong and adapted to receive fasteners for fixing said railings to said at least one bracket;

wherein each of said prongs comprises a notch, said notch being adapted to slidably engage a respective one of said channel protrusions;

wherein engagement of one of said railings with one of said brackets forms a cavity defined at least in part by said central member, said base, and said prongs; and wherein said fastener openings are angled such that said fastener openings allow said fasteners to extend through said prong and through said cavity to engage said recess in said central member at a location spaced away from said lateral channels.

7. The handrail assembly of claim 6, wherein each of said brackets further comprises:

an arm extending from said base; and a mount for securing said handrail assembly to a structure, wherein said mount is spaced apart from said railing.

8. The handrail assembly of claim 6, wherein each of said lateral channels are defined at least in part by an outer channel wall, an inner channel wall, and said upper channel wall.

9. The handrail assembly of claim 8, wherein said central member extends between said inner channel walls of said lateral channels.

10. The handrail assembly of claim 9, wherein each of said railings further comprises:

a top surface; and two side walls, wherein said side walls extend generally downwardly from said top surface and each of said side walls is attached to one of said outer channel walls.

11. The handrail assembly of claim 10, wherein each of said railings comprises an inner hollow, said inner hollow is defined at least in part by said top surface, said side walls, said upper channel walls, and said central member.

12. The handrail assembly of claim 11, further comprising one or more joins, wherein said joins are adapted to connect one of said railings to an adjacent one of said railings.

13. The handrail assembly of claim 12, wherein each of said joins extends across one longitudinal end of said one of said railings and another longitudinal end of said adjacent one of said railings.

14. The handrail assembly of claim 13, wherein each of said joins insertably engages with said inner hollows of said one of said railings and said adjacent one of said railings.

15. The handrail assembly of claim 14, wherein each of said joins is substantially hollow and comprises:

an outer cross-sectional perimeter, wherein said outer cross-sectional perimeter is greater than a perimeter of said inner hollow; and a longitudinal slit.

16. The handrail assembly of claim 11, further comprising one or more caps, wherein each of said caps comprises:

an end surface; and a railing attachment portion, wherein said railing attachment portion insertably engages with said inner hollow at one longitudinal end of one of said railings.

17. The handrail assembly of claim 16, wherein said railing attachment portion is substantially hollow and comprises:

an outer cross-sectional perimeter, wherein said outer cross-sectional perimeter is greater than a perimeter of said inner hollow; and a longitudinal slit.

18. The handrail assembly of claim 8, wherein said channel protrusions extend from said inner channel walls of said lateral channels.

19. The handrail assembly of claim 6, wherein said fastener surface is substantially perpendicular to said fastener openings.

* * * * *